United States Patent [19]

Cothery

[11] Patent Number: 4,694,576

[45] Date of Patent: Sep. 22, 1987

[54] TOOL FOR REMOVING WINDSHIELD SEALANT

[75] Inventor: Jeffrey R. Cothery, Livonia, Mich.

[73] Assignee: Reid Manufacturing Co., Inc., Southfield, Mich.

[21] Appl. No.: 898,721

[22] Filed: Aug. 14, 1986

Related U.S. Application Data

[63] Continuation of Ser. No. 799,560, Nov. 20, 1985, abandoned, which is a continuation of Ser. No. 630,949, Jul. 16, 1984, abandoned.

[51] Int. Cl.[4] ..... B26B 3/00

[52] U.S. Cl. ..... 30/280; 30/329; 30/342

[58] Field of Search ..... 30/279 R, 280, 329, 30/337, 340, 342, 335, 336; 147/42

[56] References Cited

U.S. PATENT DOCUMENTS

| | | | |
|---|---|---|---|
| 503,298 | 8/1893 | Teufel | 30/279 R X |
| 759,005 | 5/1904 | McLeod | 30/279 R |
| 1,411,452 | 4/1922 | Nielsen et al. | 30/335 |
| 2,041,806 | 5/1936 | Bartol | 30/280 X |
| 2,265,504 | 12/1941 | Zimmer | 30/279 R |
| 2,561,336 | 7/1951 | Bulsko et al. | 30/340 X |

FOREIGN PATENT DOCUMENTS

| | | | |
|---|---|---|---|
| 448676 | 6/1936 | United Kingdom | 30/280 |

*Primary Examiner*—Douglas D. Watts

*Attorney, Agent, or Firm*—Gifford, Groh, Van Ophem et al.

[57] ABSTRACT

A hand held tool for removing excess urethane sealant from the outer edges of an automotive windshield to facilitate simple replacement of the windshield. The tool generally has a handle, an elongated member with a longitudinal bore partially extending therethrough, and a removable and replaceable blade. The cutting portion of the blade is substantially U-shaped in cross-section with the exposed edges tapered and sharpened. The shape of the blade and its sharpened edges facilitate the cutting and removal of a channel within the urethane sealant in order to allow placement of a strip of plastic moulding which retains the windshield in place.

6 Claims, 4 Drawing Figures

TOOL FOR REMOVING WINDSHIELD SEALANT

This is a continuation of co-pending application Ser. No. 799,560 filed on Nov. 20, 1985, now abandoned which is a continuation of Ser. No. 670,949 filed July 16, 1984, now abandoned.

FIELD OF THE INVENTION

This invention relates to a cutting tool and, in particular, to a tool for removing the urethane sealant surrounding the edges of automotive windshields.

DESCRIPTION OF THE PRIOR ART

In the past, in order to replace the windshield of an automobile or similar vehicle, all of the sealant utilized to hold the windshield in place needed to be removed before the replacement windshield could be inserted. This resulted in increased labor expenses because of the amount of time required to remove the old sealant.

As the automotive industry modernized its assembly methods in an attempt to decrease assembly and repair costs, the means by which automotive windshields were retained in place were altered. Today, plastic moulding is utilized in conjunction with the urethane sealant to retain the glass windshield. The moulding is anchored within the urethane sealant and lays flush with the glass and the body panels. When the windshield is replaced a new channel must be cut and the excess urethane sealant removed to make room for the anchor portion of the plastic moulding piece. In order to accomplish this a cutting tool is used to make two parallel cuts in the sealant and the excess sealant is slowly pulled out of the channel. Because of the fixed dimensions of the anchor of the plastic moulding the precision required in making the cuts substantially increases the labor costs involved in the process. Moreover, after making the cut the additional step of removing the excess sealant adds to the time and cost of replacing the windshield.

SUMMARY OF THE PRESENT INVENTION

The present invention overcomes the disadvantages of the prior art by providing a tool which is capable of making the required cut and removing the excess urethane in one simple operation thereby decreasing the cost of replacing an automotive windshield.

The tool according to the present invention comprises a blade which has a cross-sectionally U-shaped cutting portion and a tubular sleeve portion. The sleeve portion of the blade is insertable into a longitudinal bore partially extending through an elongated member. The other end of the elongated member is attached to a handle which permits a firm grip of the tool. Because the sleeve portion of the blade frictionally engages the inner surface of the bore, the blade is easily removed from the tool and replaced when necessary.

In order to permit easy cutting and removal of the urethane sealant as contemplated, the exposed edges of the cutting portion of the blade are tapered and sharpened to a fine cutting edge. In use, the two parallel edges of the blade make the required cut while the U-shaped edge easily removes the urethane from the cut groove. Once the blade becomes dull and no longer operates efficiently, the blade can be removed and replaced at little additional cost.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views and in which.

DETAILED DESCRIPTION OF THE PREFERRED EMBODIMENT

Figure 1:
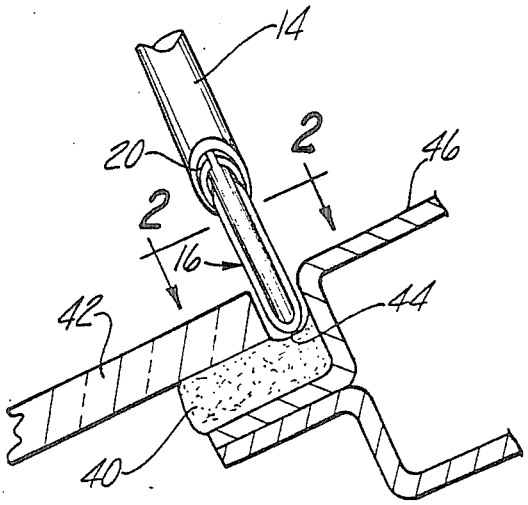
FIG. 1 is a perspective view of the tool in operation.

Referring generally to FIGS. 1 through 4, there is shown a tool 10 for removing sealant from the periphery of an automobile windshield embodying the present invention and comprising generally a handle 12, elongated member 14 and blade 16. The handle 12 and elongated member 14 are of the type found on standard hand tools and permit firm yet simple handling and use of the device. In the preferred embodiment, the elongated member 14 is of substantially solid construction to add strength to the tool 10 and is at least partially embedded within the handle 12.

The metal-alloy blade 16 comprises a cutting member 18 and a sleeve member 20. The cutting member 18 of the blade 16 is generally U-shaped in cross-section and comprises U-shaped lead edge 23 and two parallel edges 22 and 24. The edges 23, 22 and 24 are all tapered and sharpened to permit ease of cutting and removing the urethane sealant. A description of the operation of the device will be discussed in detail hereinafter.

The sleeve member 20 of the blade 16 frictionally engages the inner wall 26 of a longitudinal bore located in end 30 of the elongated member 14. The bore extends into end 30 of the elongated member 14 a distance which corresponds to the length of the sleeve member 20 of the blade 16. Wall 32 of the longitudinal bore thereby limits the distance that the sleeve member 20 can travel and provides support during operation of the device.

Figure 2:
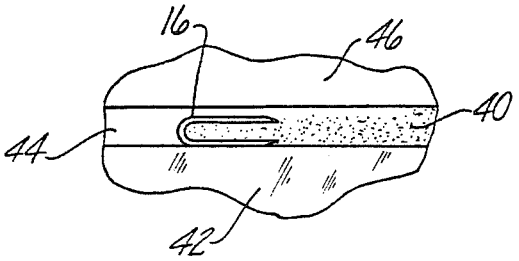
FIG. 2 is a cross section of the tool in operation taken along line 2—2.
Figure 3:
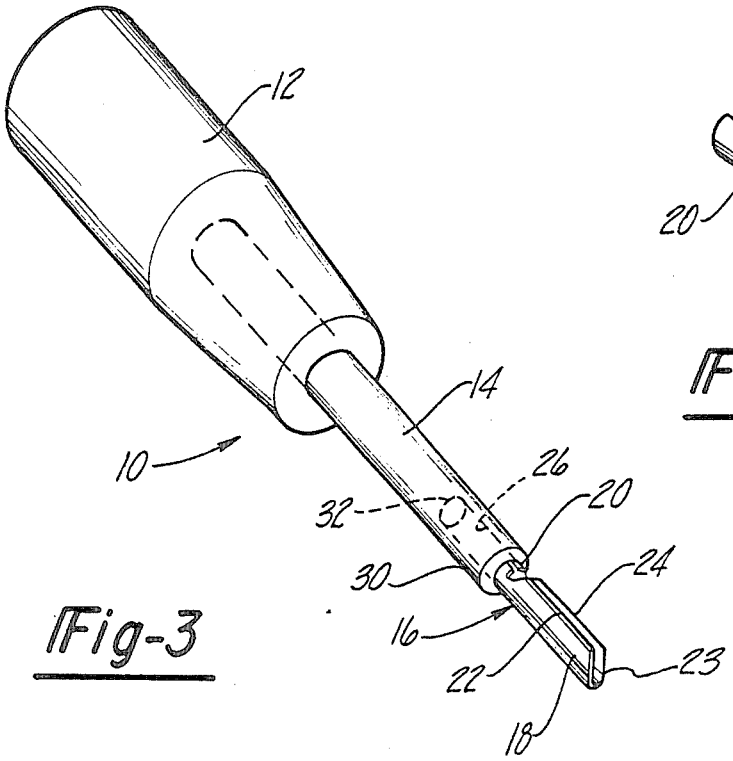
FIG. 3 is a perspective view of the tool embodying the present invention.
Figure 4:
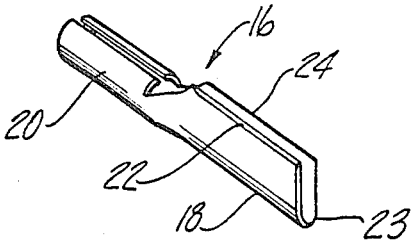
FIG. 4 is a perspective view of the removable blade utilized in the tool.

Referring now to FIGS. 1 and 2, operation of the tool 10 substantially simplifies the removal of excess sealant from the periphery of an automobile windshield enabling the plastic moulding to be reinstalled with ease. During removal of the old windshield, the majority of the urethane sealant 40 is left intact to serve as a bed for the replacement windshield 42. Modern techniques have simplified the process of anchoring the new windshield by utilizing a strip of plastic reveal moulding (not shown) to retain the windshield 42 in place. To simplify the reinstallation of the plastic moulding, a channel 44 must be cut between the windshield 42 and the body panel 46. The tool 10, as embodied in the present invention, chisels out just enough of the old urethane sealant 40 to create the proper channel 44. Because the plastic moulding is of a fixed dimension the parallel edges 22 and 24 cut the proper channel. Moreover, the U-shaped forward edge 23 separates the excess sealant 40 from the channel 44. The plastic moulding is then easily put in place in the channel 44 flush with the windshield 42 and the body panel 46.

The foregoing detailed description has been given for clearness of understanding only and no unnecessary limitations should be understood therefrom as some modifications will be obvious to those skilled in the art.

What is claimed is:

1. A tool for forming a groove of fixed width in a urethane sealant disposed about the periphery of an automobile windshield, the groove so formed being dimensioned to receive a windshield-retaining molding thereon, said tool comprising:

an elongated member defining a longitudinal axis of said tool, said member comprising a first end portion, and a secone end portion opposite said first end portion;

a handle affixed to said first end portion of said elongated member; and a blade comprising a mounting sleeve and a cutting member affixed to said mounting sleeve;

wherein said second end portion of said elongated member defines a longitudinal bore extending partway through said elongated member, said bore being closely dimensioned to said mounting sleeve so that said second end portion detachably frictionally engages said sleeve when said mounting sleeve is inserted in said bore;

wherein said cutting member is substantially U-shaped in cross section transverse to said longitudinal axis of said tool defined by said elongated member; and wherein said cutting member comprises a pair of longitudinally extending, radially opposed edges, and a pair of laterally extending, radially opposed second edges disposed perpendicularly to said longitudinally extending edges, opposite said mounting sleeve.

2. The invention according to claim 1, wherein said mounting sleeve is substantially cylindrical in shape.

3. The invention according to claim 1, wherein said cutting member comprises a pair of laterally extending, radially opposed third edges.

4. The invention according to claim 1, wherein said pairs of edges are each tapered and sharpened to a cutting edge.

5. The invention according to claim 1, wherein said first end portion of said elongated member is embedded in said handle.

6. The invention according to claim 1, wherein said mounting sleeve comprises a portion defining a slot disposed in a direction parallel to said longitudinal axis, said mounting sleeve being compressed by said second end portion when inserted into said bore.

* * * * *